US010856717B2

(12) United States Patent
Snider et al.

(10) Patent No.: US 10,856,717 B2
(45) Date of Patent: Dec. 8, 2020

(54) RELEASE LEVER FOR MAGNETIC SWEEPER WITH THREE-SIDED CHANNEL STRUCTURE

(71) Applicant: Atlantic Exchange Inc., Wallburg, NC (US)

(72) Inventors: Steven Jay Snider, Grafton, OH (US); Lowell Lamar Snider, Wallburg, NC (US); Hendrik H. Drenth, Wallburg, NC (US); Jaap J. Drenth, Wallburg, NC (US)

(73) Assignee: Atlantic Exchange Inc., Wallburg, NC (US)

( * ) Notice: Subject to any disclaimer, the term of this patent is extended or adjusted under 35 U.S.C. 154(b) by 0 days.

(21) Appl. No.: 15/825,850

(22) Filed: Nov. 29, 2017

(65) Prior Publication Data

US 2018/0271347 A1 Sep. 27, 2018

Related U.S. Application Data

(60) Provisional application No. 62/429,382, filed on Dec. 2, 2016.

(51) Int. Cl.
*A47L 13/41* (2006.01)

(52) U.S. Cl.
CPC ..... *A47L 13/41* (2013.01); *B03C 2201/28* (2013.01)

(58) Field of Classification Search
CPC ..... A47L 13/41; B03C 2201/28
USPC ..... 209/417, 418, 419, 420
See application file for complete search history.

(56) References Cited

U.S. PATENT DOCUMENTS 2,654,480 A * 10/1953 Stem ..... B03C 1/30 209/215
2,709,002 A * 5/1955 Hoff ..... A47L 13/41 209/215
3,014,586 A * 12/1961 Ross ..... A47L 13/41 209/215
5,285,904 A * 2/1994 Haase ..... B03C 1/035 209/215
6,142,310 A * 11/2000 Haase ..... A47L 13/41 15/339
6,158,792 A * 12/2000 Snider ..... A47L 13/41 209/215
2007/0084759 A1* 4/2007 Shiao ..... B03C 1/0332 209/221

(Continued)

FOREIGN PATENT DOCUMENTS

DE 20021734 U1 * 5/2001 ..... B03C 1/28

*Primary Examiner* — Terrell H Matthews
(74) *Attorney, Agent, or Firm* — NK Patent Law

(57) ABSTRACT

A free-floating, hinged release lever on an incorporated track to a three-sided extruded channel housing, which holds multiple magnets with opposite polarity. The housing has a steel top plate to allow for centering a female ACME connector for the attachment of a handle and to allow for an axle at each end to hold wheels for ease of conveyance. After the three-sided extruded channel housing—encapsulated by the free-floating, hinged release lever—has collected ferrous debris, the release lever is pushed away from the housing to allow for easy removal of ferrous material by it falling off by gravitational force without the operator having to be in contact with the metal debris. The magnets remain in place during the entire removal process.

11 Claims, 3 Drawing Sheets

(56) References Cited

U.S. PATENT DOCUMENTS

2008/0078698 A1* 4/2008 Lin ..... A47L 13/41
209/215
2010/0213108 A1* 8/2010 Al-Hasan ..... B03C 1/0335
209/706

* cited by examiner

RELEASE LEVER FOR MAGNETIC SWEEPER WITH THREE-SIDED CHANNEL STRUCTURE

FIELD OF THE INVENTION

The present invention pertains generally to magnets and magnetic devices and, more in particular, to the functional features on magnetic hand tools. These features cooperate with housed or mounted magnets and, in this case, it is a release lever, that can be used to release collected ferrous materials by normal gravitational pull.

BACKGROUND OF THE INVENTION

Magnetic tools, such as hand tools, require some type of supported structure or housing for magnetized material, and other functional aspects, such as a grip, conveyance, such as wheels or other mechanisms for better or saver performance of the tool. The type and purpose of the tool dictates the mounting or housing structure for the magnet as well as the needed features.

In a hand-operated magnetic sweeper, designed to pick up ferrous objects off the floor, it is desirable to have the magnets positioned in a housing, which supports, protects and surrounds the magnets.

Then to remove any collected ferrous metal debris from the housing, it is preferred to not do this by hand to avoid any accidental injury by the sharp edges of the debris. Often, magnetic hand tools are cleaned by hand or the magnet is pulled up as to remove the magnetic flux from the metal debris. In the latter, the debris falls away from the hand tool by gravitational force. However, this action is not advised ergonomically as the operator has to bend over to pull up a heavy magnet and/or takes the risk of getting injured.

With the free floating, hinged release lever, the operator of the hand tool does not have to bend over nor have to pull up a heavy magnet to aid in the release of collected metal debris or do so by hand risking injury.

BRIEF SUMMARY OF THE INVENTION

The present invention provides a free floating, hinged release lever for a magnet sweeper hand tool. In accordance with the principles of the invention, the magnet sweeper has a three-sided channel structure, which houses one or more magnets in a, generally, linear arrangement.

The open side of the channel is covered by a steel top plate, which covers the remaining exposed surface of the magnet(s). The steel top plate serves both as the primary structural member of the magnet sweeper hand tool, as well as to direct the magnetic flux downward away from the steel top plate toward a floor surface over which the tool is conveyed by wheels or other conveyance.

The steel top plate covering the open side of the extruded channel and the exposed surface of the magnet(s) is of a different material then the channel, so as to not short the magnetic circuit within the housing formed by the extruded channel and steel top plate.

As the primary structural member of the tool, the steel top plate further functions to support two axles for the mounting of wheels at opposite ends of the plate as well as a female ACME collar to facilitate the attachment of a handle.

A free-floating release lever is connected to the extruded three-sided channel housing by hinge that is slid into the track of the housing. Its design, in combination with the track portion of the extruded housing and the positioning ridge inside the inward wall of the track, make it so that there is no binding of the free-floating hinged release lever while it can be used in a fluid motion in the release of ferrous materials.

The moment metal debris is within the magnetic flux of the magnets, it will be pulled up anti-gravitationally and, as such, push the lever against the three-sided housing channel and close the gap between the free-floating hinged release lever and the extruded housing.

Then, when the lever is pushed away from the extruded housing, all metal debris is physically positioned outside the force of the magnetic flux and falls off the magnet sweeper hand tool by simple gravitational force.

Therefore, the invention is the three-sided extruded channel, that has an incorporated track for a free-floating hinged release lever. The release lever has been designed specifically as a means of easily removing ferrous material attracted by the three-sided channel, that allows to pass through the magnetic field from the magnets. As a means of incorporating minimal mechanical friction, the magnets are allowed to remain in a static position within the housing. A free-floating release lever is incorporated via a hinge into the extruded housing as to create a space gap between the magnetic field and the ferrous materials collected when operated. This allows for easy removal of the ferrous material without the operator having to be in direct contact with it.

These and other aspects of the invention are described herein in detail with reference to the accompanied Figures, which are denoted with reference numbers associated with the various components and parts of the invention.

DESCRIPTION OF THE FIGURES

The benefits and advantages of the present invention will become more readily apparent after reviewing the following detailed description and accompanying drawings, wherein.

DETAILED DESCRIPTION OF THE INVENTION

Figure 1:
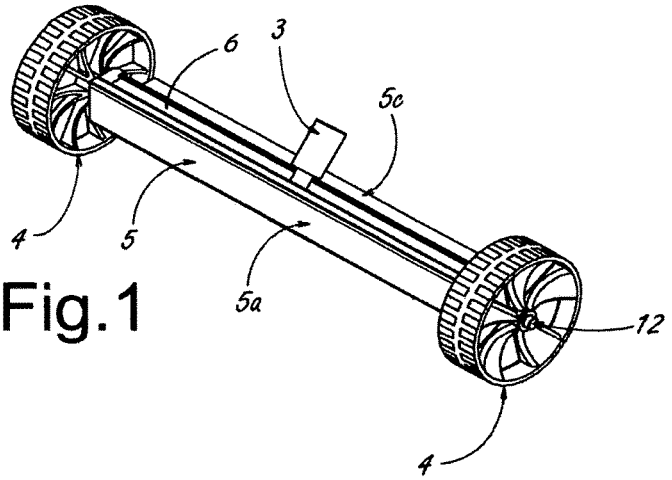
FIG. 1 is a perspective view of a three-sided extruded channel structure 11 encompassed by the free-floating hinged release lever 5. It shows the wheels 4 for conveyance as well as an ACME collar 3 to attach a handle. Also, shown is the steel plate 6, the front side 5*a* and the lever side Sc of the release lever with push caps 12 to hold the wheels in place.
Figure 2:
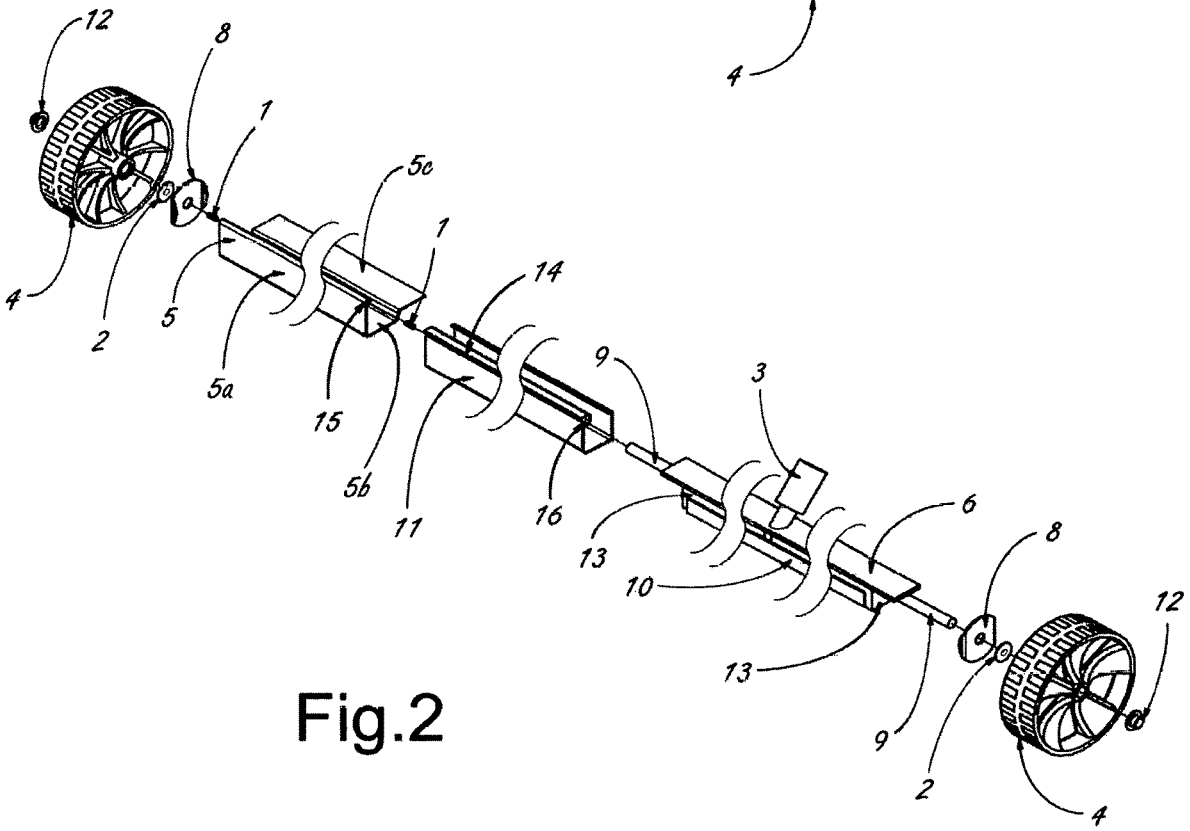
FIG. 2 is an exploded perspective view of FIG. 1.

With reference to FIG. 1, FIG. 2, there is illustrated a free-floating hinged release lever for a magnet sweeper hand tool with a three-sided housing channel. The free-floating hinged release lever with a three-sided housing structured magnet sweeper include the main component parts consisting of a 14" long, flat bar of steel 6, that acts as support for the axles 9 and doubles as a shield to focus the magnetic field in a downward direction. The right and left axles 9 are welded to the top plate 6 along with the ACME collar 3 on the center and top of the steel plate 6, which is zinc plated to protect the surface from the elements. Multiple ceramic magnets 13 are placed under the steel top plate 6 and two additional magnetic shielding strips 10 are attached to the front and rear of the magnets 13 to help focus the magnetic field in a downward direction. This entire assembly FIG. 1, FIG. 2, FIG. 6 slides into the extruded three-sided housing channel 11, FIG. 2, FIG. 6, FIG. 7 as to house all parts.

Figure 3:
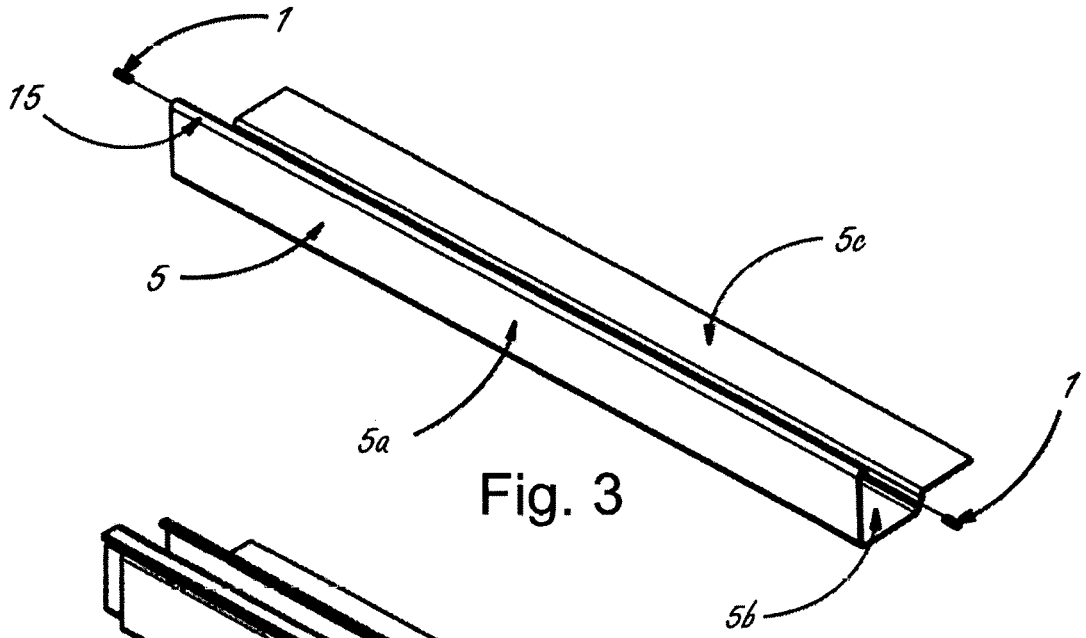
FIG. 3 is a perspective view of the free-floating release lever and an exploded view of the spacers 18 as an extension of the hinge part of the release lever.
Figure 4:
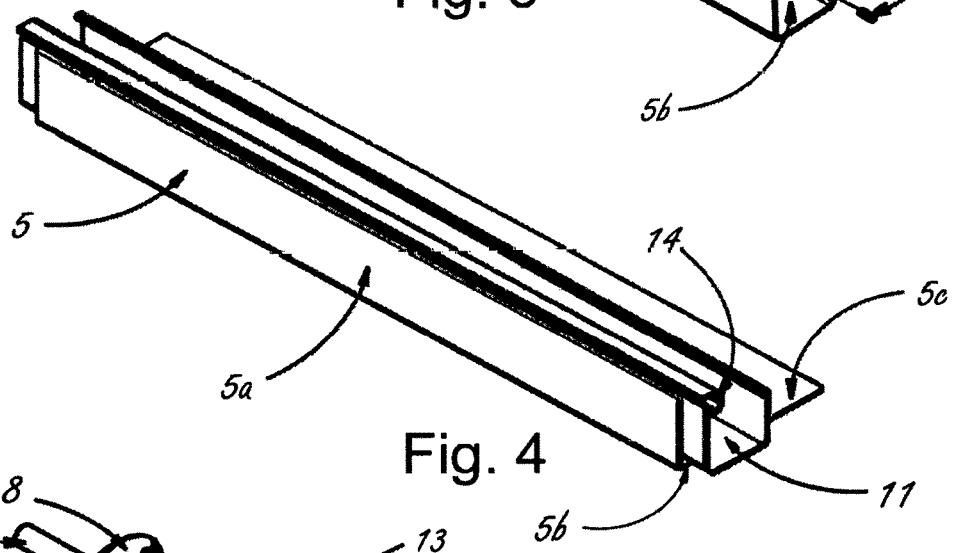
FIG. 4 is a perspective view of the free-floating hinged release lever 5, with front side 5*a*, with partly the bottom side 5*b* and lever-side Sc, encompassing the extruded three-sided housing channel 11 with the linear track 14 shown.
Figure 5:
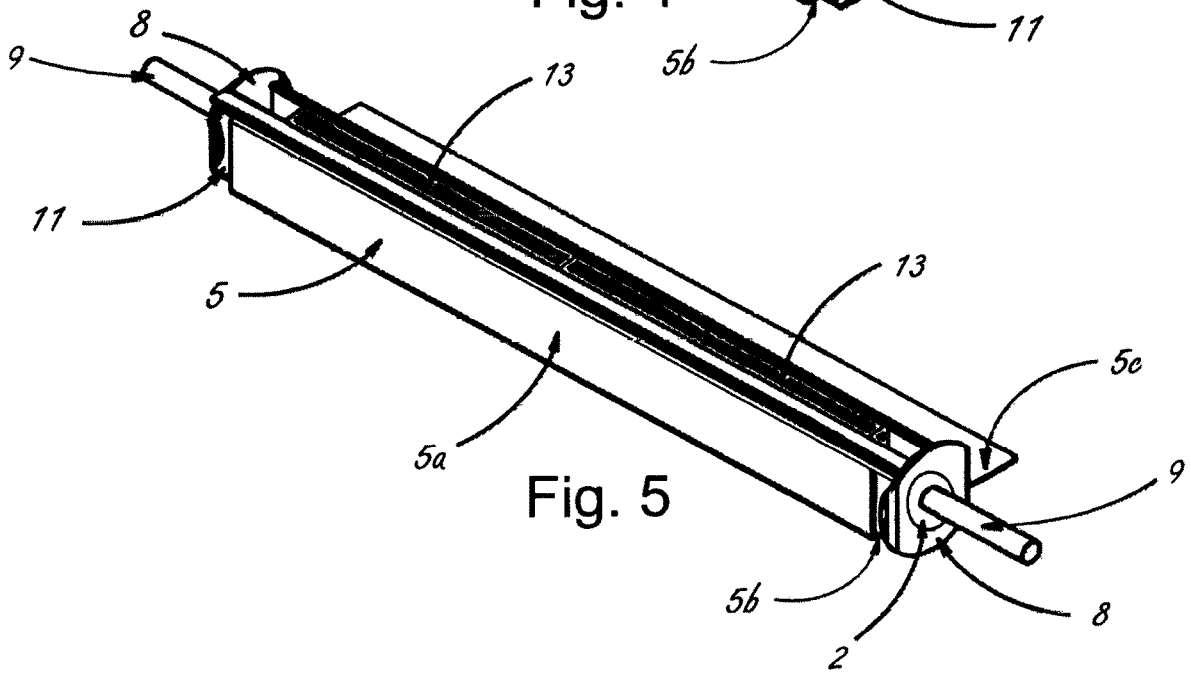
FIG. 5 is a perspective view of the same as in FIG. 4, but with added a perspective view of the magnets 13, the axles 9, a lock tooth washer 17, a symmetrically bent stop washer 8.
Figure 6:
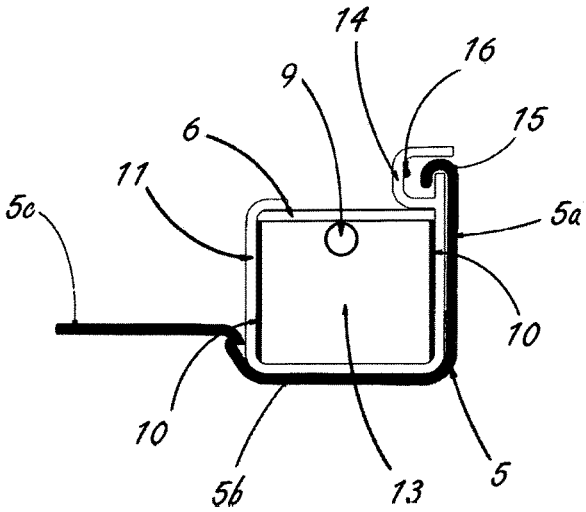
FIG. 6 is a cross-cut view of the free-floating release lever 5 that encompasses the three-sided housing channel 5 with on top a steel plate 6 with axle 9. The magnet(s) 13 shown inside the housing channel 5 and magnetic shielding strips 10. On the inside of the track portion 14, the positioning ridge 16. The free-floating release lever 5 has a 'hinge portion' 15 to allow it to be connected freely to the track portion 14 of the extruded housing channel.

The track portion 14 of the extruded three-sided housing channel 11 allows for the free-floating release lever hinge 15 to pivot without mechanically fastening the three-sided extruded housing channel FIG. 2, FIG. 6 and the free-floating release lever FIG. 3, FIG. 6, together.

Figure 9:
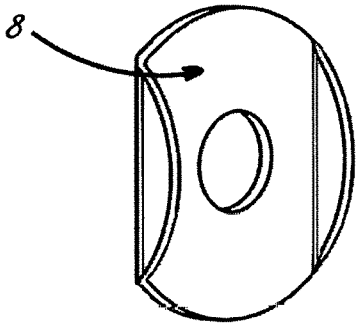
FIG. 9 is a cross-cut view of a symmetrically bent stop washer 8.

Two specially formed stop washers 8, FIG. 9, each symmetrically bent in the same direction 90 degrees on opposite sides at 15.385% inside the diameter FIG. 9, are placed down the axles 9 covering the ends of the extruded channel FIG. 2 and preventing dirt or debris from easily entering the sweeper unit FIG. 1, FIG. 2. Two spacers 18, FIG. 2 are positioned on either side of the tracking portion 14 after the hinge 15 of the free-floating release lever 5 has been positioned in place. A lock tooth washer 17 is positioned behind the stop washers 8 to keep the entire assembly in a fixed position. Two 4-inch plastic wheels 4 provide the proper ground clearance for the entire three-sided housing structured magnet sweeper unit FIG. 1 to roll freely across various types of surfaces, such as grass, gravel, sand, and multiple kinds of floor surfaces, while collecting ferrous debris. Two push nut caps 12 are placed over the ends of the axles keeping the assembly FIG. 2 together, but also allowing to be removed for cleaning or easy replacement of any part or component. The free-floating release lever FIG. 1, FIG. 2, has been specifically designed for the easy collection and release of various ferrous material.

The moment metal debris is within the magnetic flux of the magnet(s) 13, it will be collected by the magnet sweeper FIG. 1 as the metal debris pushes the free-floating hinged lever against the three-sided housing channel 11 and close the gap between the free-floating hinged release lever 5 and the extruded three-sided housing channel 11.

Figure 7:
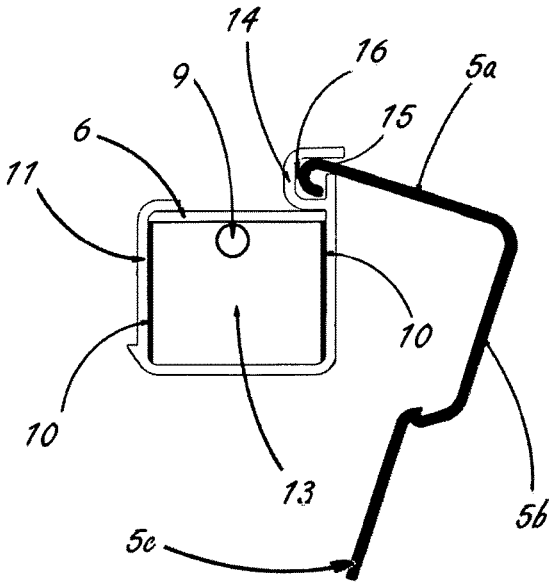
FIG. 7 is a cross-cut view of the same as in FIG. 6, but with activated release lever in open, 'releasing' position.
Figure 8:
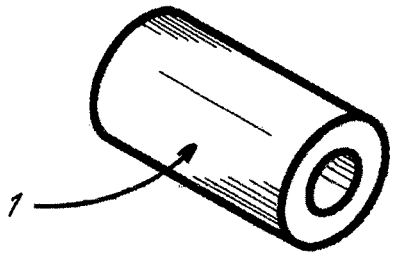
FIG. 8 is a cross-cut view of a spacer 18.

When the free-floating release lever 5, 5*c*, FIG. 7 is being pushed away from the extruded three-sided housing channel, all metal debris will be physically positioned outside the force of the magnetic flux resulting in falling off the magnet sweeper hand tool FIG. 1 by simple gravitational force. The use of the free-floating hinged release lever 5, FIG. 1, FIG. 7 can be recommenced and repeated as described above until all ferrous debris has been collected from the surface area.

The free-floating release lever 5, FIG. 3, FIG. 6, FIG. 7 has been designed specifically as a means of easily removing ferrous material attracted by magnet sweepers with a three-sided housing channel 11, that allows to pass through the magnetic field from the magnets. As a means of incorporating minimal mechanical friction, the magnets are to remain in a static position within the housing. A free-floating, hinged release lever 5, FIG. 3, FIG. 6, FIG. 7 is incorporated via a hinge into the extruded three-sided housing channel 11 as to create a space gap between the magnetic field and the ferrous materials collected when operated. This allows for easy removal of the ferrous material without the operator having to be in direct contact with it nor to risk injury.

The invention claimed is:

1. A magnetic broom assembly comprising:

a handle having an elongated portion;

a housing having a first outwardly facing end and having a first wheel extending outwardly from the first end thereof and a second outwardly facing end and having a second wheel extending from the second end thereof, the first end and second end being spaced-apart, wherein the housing is pivotable along a longitudinal extending between the first wheel and the second wheel;

a magnet positioned about the housing;

a cover extending across a bottom facing portion of the magnet, the cover having a first position in which the cover is positioned closely-spaced with the magnet and moved to a second position in which the cover is spaced-apart from the magnet to reduce the magnetic forces acting upon the cover, wherein the cover is coupled to the housing through a hinge, wherein the cover is rotated from the first position to the second position about the hinge, wherein the cover defines a flange extending therefrom, wherein the flange extends beyond a periphery of the housing, wherein translation forces applied to the flange impart rotation of the cover about the hinge, wherein the cover is positioned below the longitudinal extending between the first wheel and the second wheel when the cover is in the first position in which the cover is positioned closely-spaced with the magnet.

2. The broom assembly according to claim 1, wherein the handle is selectively attached with the housing.

3. The broom assembly according to claim 1, wherein the magnet is integrally formed with the housing.

4. The broom assembly according to claim 1, wherein the cover is non-ferrous.

5. The broom assembly according to claim 4, wherein the hinge is formed by a lip extending from the cover, the lip being positioned within a channel defined on a top facing portion of the housing.

6. The broom assembly according to claim 4, wherein the longitudinal about which the first wheel and the second wheel rotates is parallel to an axis extending through the hinge.

7. A magnetic broom assembly comprising:

a handle having an elongated portion;

a housing having a first wheel on a first terminal end thereof and a second wheel on a second terminal end thereof spaced-apart from the first end;

a magnet positioned about the housing;

a cover extending across a bottom facing portion of the magnet, the cover having a first position in which the cover is positioned closely-spaced with the magnet and moved to a second position in which the cover is spaced-apart from the magnet to reduce the magnetic forces acting upon the cover, wherein the cover is non-ferrous and is coupled to the housing through a hinge, wherein the cover is rotated from the first position to the second position about the hinge, wherein a longitudinal extending through the first wheel and the second wheel is parallel with the hinge such that translation of the handle imparts a pitch of the broom assembly in a first direction, and translation of the cover about the hinge imparts a pitch of the cover in a second direction that is opposite of the first direction, wherein the cover is coupled to the housing through a hinge, wherein the cover is rotated from the first position to the second position about the hinge, wherein the cover defines a flange extending therefrom, wherein the flange extends beyond a periphery of the housing, wherein translation forces applied to the flange impart rotation of the cover about the hinge, wherein the cover is positioned below the longitudinal extending between the first wheel and the second wheel when the cover is in the first position in which the cover is positioned closely-spaced with the magnet.

8. The broom assembly according to claim 7, wherein the hinge is formed by a lip extending from the cover, the lip being positioned within a channel defined on a top facing portion of the housing.

9. The broom assembly according to claim 7, wherein the handle is selectively attached with the housing.

10. The broom assembly according to claim 7, wherein the magnet is integrally formed with the housing.

11. The broom assembly according to claim 7, wherein the cover is non-ferrous.

* * * * *